US009936825B1

(12) United States Patent
Lindblom et al.

(10) Patent No.: US 9,936,825 B1
(45) Date of Patent: Apr. 10, 2018

(54) CONVERTIBLE MULTILEVEL SHELVING UNIT AND DISPLAY FIXTURE

(71) Applicant: STREATER LLC, Albert Lea, MN (US)

(72) Inventors: Thomas G. Lindblom, Claremont, MN (US); Wayne Lee Jensen, Ellendale, MN (US); David W. Linn, Alden, MN (US); Jessica Andrea Mieritz, Germantown, WI (US)

(73) Assignee: Streater, LLC, Albert Lea, MN (US)

( * ) Notice: Subject to any disclaimer, the term of this patent is extended or adjusted under 35 U.S.C. 154(b) by 0 days.

(21) Appl. No.: 15/425,541

(22) Filed: Feb. 6, 2017

(51) Int. Cl.

| | |
|---|---|
| ***A47F 5/08*** | (2006.01) |
| ***A47B 23/04*** | (2006.01) |
| ***A47F 5/00*** | (2006.01) |
| ***A47F 5/10*** | (2006.01) |
| ***A47F 5/13*** | (2006.01) |
| ***A47B 57/04*** | (2006.01) |
| ***A47F 5/12*** | (2006.01) |

(52) U.S. Cl.
CPC ..... *A47F 5/0087* (2013.01); *A47B 57/04* (2013.01); *A47F 5/0018* (2013.01); *A47F 5/0037* (2013.01); *A47F 5/0815* (2013.01); *A47F 5/103* (2013.01); *A47F 5/108* (2013.01); *A47F 5/12* (2013.01); *A47F 5/137* (2013.01)

(58) Field of Classification Search
CPC .... A47F 5/0087; A47F 5/0018; A47F 5/0815; A47F 5/108; A47F 2005/165; A47F 5/0037; A47F 5/12; A47F 5/16; A47F 5/0081; A47F 5/135; A47F 5/137; A47F 5/10; A47F 5/103; A47B 57/04; A47B 46/00; A47B 46/005; A47B 57/045; A47B 19/06; A47B 2200/0043; A47B 27/02; A47B 57/26; A47B 57/54
USPC ..... 211/2, 13.1, 150, 169, 195; 108/6, 99, 108/115
See application file for complete search history.

(56) References Cited

U.S. PATENT DOCUMENTS

| | | | | | |
|---|---|---|---|---|---|
| 274,162 | A * | 3/1883 | Wilson | A47B 27/02 | 108/9 |
| 421,540 | A * | 2/1890 | Barber | A47F 5/116 | 211/132.1 |
| 485,627 | A * | 11/1892 | Hamblin | A47F 5/112 | 108/100 |
| 786,526 | A * | 4/1905 | Sollom | A47B 85/06 | 108/15 |
| 1,705,237 | A * | 3/1929 | Bulman | A47F 5/12 | 108/8 |

(Continued)

FOREIGN PATENT DOCUMENTS

CN 201452444 U 5/2010

OTHER PUBLICATIONS

International Search Report and Written Opinion of the International Searching Authority dated Oct. 25, 2017.

*Primary Examiner* — Jennifer E. Novosad
(74) *Attorney, Agent, or Firm* — Nikolai & Mersereau, P.A.; Thomas J. Nikolai

(57) ABSTRACT

A display fixture having a plurality of display panel assemblies that can each be independently pivoted between and held in either a horizontal and a vertical position may be easily configured for use as either a shelving unit or a display rack or a combination shelving unit and display rack by a user.

20 Claims, 14 Drawing Sheets

(56) References Cited

U.S. PATENT DOCUMENTS 2,445,164 A * 7/1948 Worthman ..... A47G 25/0664 108/38
2,908,397 A * 10/1959 Patterson ..... A47B 46/005 108/179
2,919,034 A * 12/1959 Levy ..... A47B 57/045 108/1
2,992,742 A * 7/1961 Pendergrast, Jr. .... A47F 5/0037 108/146
3,107,442 A * 10/1963 Levine ..... A47B 83/008 434/47
3,151,576 A * 10/1964 Patterson ..... A47F 5/0087 108/152
3,204,689 A * 9/1965 Howell ..... E04B 2/7444 160/135
3,226,172 A 12/1965 Bateman
3,468,039 A * 9/1969 Dubbert ..... A47B 97/04 108/166
3,677,203 A * 7/1972 Barrineau ..... A47F 5/0037 108/166
4,276,984 A * 7/1981 Simmons ..... A47B 73/00 211/81
4,678,090 A * 7/1987 Ross ..... B62B 3/186 211/150
4,750,623 A * 6/1988 Flum ..... B65D 1/70 211/150
4,862,812 A * 9/1989 Godfrey ..... A47B 5/006 108/47
5,505,318 A * 4/1996 Goff ..... A47B 46/00 211/132.1
5,526,944 A * 6/1996 Merl ..... A47F 5/0081 108/108
5,590,796 A * 1/1997 Herman ..... A47F 5/108 108/99
5,607,070 A 3/1997 Hellyer
5,749,480 A * 5/1998 Wood ..... A47B 57/04 211/150
5,816,419 A * 10/1998 Lamson ..... A47B 57/045 211/150
RE36,379 E * 11/1999 Slivon ..... B25H 3/023 312/271
6,659,295 B1 * 12/2003 De Land ..... A47B 96/04 211/184
6,811,233 B1 * 11/2004 Packer ..... B25H 1/04 108/176
7,249,680 B2 * 7/2007 Wang ..... A47B 57/04 211/150
7,424,958 B1 * 9/2008 Eley ..... B25H 3/04 211/70.6
7,954,655 B2 * 6/2011 Virvo ..... A47F 5/0043 211/149
8,109,579 B2 * 2/2012 English ..... A47B 96/062 211/150
8,281,943 B2 * 10/2012 Suman ..... A47F 5/0087 211/150
8,665,583 B2 * 3/2014 Kinsley ..... A47B 46/005 211/150
9,615,678 B1 * 4/2017 Lindblom ..... A47F 5/0087
2005/0110372 A1 * 5/2005 Vardaro ..... A47B 5/00 312/248
2008/0142463 A1 6/2008 Johnson
2008/0143069 A1 6/2008 Richards et al.
2009/0001038 A1 * 1/2009 Zimmer ..... A47F 5/116 211/135
2010/0264103 A1 * 10/2010 Johnson ..... A47B 57/20 211/150
2011/0001415 A1 * 1/2011 Park ..... F25D 25/02 312/408
2016/0058211 A1 3/2016 Weinstein et al.

* cited by examiner

CONVERTIBLE MULTILEVEL SHELVING UNIT AND DISPLAY FIXTURE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

This invention relates to display fixtures used in stores and other environments to display merchandise. More specifically, this invention relates to display fixtures that may be converted and used either as (i) a vertical rack on which merchandise may be displayed using hooks, hangers and other accessories, or (ii) a multilevel shelving unit upon which merchandise may be placed, or (iii) a combination vertical display rack and shelving unit.

2. Related Art

A variety of fixtures are used in retail stores to display merchandise to customers. Periodically, store operators will rearrange and reconfigure the store fixtures and the merchandise displayed thereon to entice customers to make purchases.

Many retailers find retail space to be at a premium and find storage space in particular to be limited. Thus, there is a need for store fixtures that can be reconfigured so they can be used in various ways and thereby eliminate storage issues. An example of such a fixture is shown in U.S. Pat. No. 3,226,172, granted on Dec. 28, 1965, to J. A. M. Bateman. The Bateman patent discloses a merchandise display fixture adapted to be arranged for use either as a table-top counter or as a gondola. As discussed in Bateman, at times it is desirable to display large quantities of merchandise within easy reach of customers, such as during certain promotional sale periods. A common way to display large quantities of merchandise is to stack them on a tabletop. At other times, it becomes desirable to obtain the maximum efficiency in the presentation of the merchandise so as to attract the attention of the customer by the manner in which the merchandise is displayed. Merchandise can be more attractively displayed and more easily examined by the customer using a gondola-style fixture. Thus, Bateman discloses an apparatus that can be converted and used either as a tabletop, gondola, or a combination of a gondola and tabletop. Converting Bateman's apparatus is somewhat complex and not easily or efficiently achieved. This will be appreciated by one of ordinary skill in the art reviewing the drawings of the Bateman patent and seeing the many different parts and assemblies that need to be reconfigured to convert Bateman's apparatus.

Presently, there is a real need for display fixtures that can easily, quickly and efficiently be converted between various configurations and which also can be easily moved about and locked in place, all by a single person and in less than a minute. Likewise, there is a real need for such display fixtures that can be converted without any tools and display fixtures that can be converted without extraneous parts (other than hooks, hangers and similar accessories) that are not permanently attached and, thus, can become separated from the display fixture and lost when not in use.

SUMMARY OF THE INVENTION

Easily, quickly and efficiently converting a display fixture can be achieved by providing a display fixture including a base having a front end and a back end, first and second vertical support rails (pillars) each secured to the base and projecting upwardly from the base in spaced apart parallel relation, and a plurality of panel assemblies. Each panel assembly comprises a first face and a second face, at least one display panel, and a frame adapted to hold the display panel(s). The frame typically will include first and second sides and first and second ends. Each panel assembly is coupled to the two pillars by first and second pivot assemblies. These pivot assemblies pivotally attach the sides of the frame to the pillars such that the pivot assemblies defined an axis of rotation about which the panel assembly rotates between a vertical position and a horizontal position. Since separate pairs of pivot assemblies are used to couple each of a plurality of panel assemblies to the pillars, each panel assembly can be rotated independently of the others.

In some situations, it will be desirable to place the fixture away from a wall in an open area. In such cases, the pillars are mounted to the base along a line half way between the front end and the back end of the base. Also, the panel assemblies are pivotally mounted to the pillars along a line defining an axis of rotation half way between the first and second ends of the panel assembly such that when the panel assemblies are in the horizontal position a portion of the panel assembly projects forward of the pillars and another portion of the panel assembly projects rearward of the pillars.

In other situations, it will be desirable to position the fixture against a wall. In such cases the pillars are mounted to the base adjacent the back end of the base and the panel members are mounted to the pillars along a line defining an axis of rotation immediately adjacent an end of the panel assembly.

At least one latch assembly is provided for each of the panel assemblies. For additional strength and security, two such latch assemblies may be provided for each of the panel assemblies. These latch assemblies are adapted to releasably and independently lock the panel assemblies in either the first vertical position or the second horizontal position. The latch assemblies can be released to enable selected panel assemblies to be pivoted (rotated) between the first vertical position and the second horizontal position.

When a panel assembly is in the horizontal position, the panel assembly serves as a shelf. When a panel assembly is in the vertical position, the panel assembly provides a vertical mounting surface to which accessories such as hooks, hangers, bins, baskets or any of a variety of other accessories may be mounted. The display panel(s) of the display assemblies may, for example, be a sheet of pegboard (i.e., a board with an organized pattern of holes drilled through the board) or a wire grid. In any case, the display panels are not just a flat sheet of material, but instead are adapted to permit accessories to be quickly attached to and supported by the display panel. The display panels are also strong enough when placed in the frame to support, without breaking, merchandize or the like place on the display panel when the panel assembly is in the horizontal position and serving as a shelf.

The above-referenced latch assemblies are very simple and easily operated. The latch assemblies employed will depend on whether it is desirable to have the panel assembles project from the pillars in only one direction or in two opposing directions when the panels assemblies are horizontal. In either case, each latch assembly is adapted to lock the panel assembly in both the horizontal position and the vertical position.

When panel assemblies are adapted to project in two opposing directions from the pillars when horizontal, each latch assembly typically will include a stationary stop such as a stationary pin and a retractable stop such as a retractable pin. The retractable stop is movable between a retracted position and an extended position. When the panel assembly is locked in the vertical position, the stationary stop of the latch assembly engages a first face of the panel assembly and the retractable stop of the latch assembly is in its extended position such that the retractable pins engage a second face of the panel assembly. When the panel assembly is locked in the horizontal position, both the stationary pin and the retractable pin engage the first face and are below the panel assembly. When the retractable pins of two latch assemblies associated with a specific panel assembly are both retracted, the panel assembly is free to rotate between the first vertical position and the second horizontal position.

More specifically, while only one latch assembly per panel assembly may be needed in some cases, in other cases separate pairs of latch assemblies (i.e., first and second latch assemblies) are associated with each of the panel assemblies. Further, the first latch assemblies are associated with one of the vertical pillars and the second latch assemblies are associated with the other vertical pillar. Each pair of latch assemblies can be separately operated enabling each panel assembly to be operated independently, i.e., moved between the horizontal and vertical position as desired and then locked in place in the desired position.

When the panel assemblies are mounted to the pillars so they extend in only one direction from the pillar, the latch assemblies are of a modified design. For example, each latch assembly may include a stationary pin on which the panel assembly rests when horizontal and a retractable pin that can be extended from the pillar to penetrate a hole in the frame of the panel assembly when the panel assembly is vertical and retracted from the hole in the frame to allow the panel assembly to be moved from the vertical to the horizontal. Alternatively, the attach assemblies may include three pins. One that supports the panel assembly in the horizontal position and two that engage opposing faces of the panel assembly when in the vertical position, at least one of which being retractable.

Given that each of the panel assemblies can be positioned independently of the others means that the display fixture can be configured in various ways. That number is essentially two to a power equal to the number of panel assemblies employed. For example, if there are two panel assemblies, then there are four different configurations. If there are three panel assemblies, then there are eight different configurations. If there are four panel assemblies, then there are sixteen different configurations, etc. When the display fixture includes eighteen independently operable panel assemblies, the panel assemblies can be configured in 262,144 different ways.

Further, each individual panel assembly can include two pegboard panels and two grid panels, such that each panel can be configured in four different ways (i.e., (1) with two exposed grid panels, (2) with two exposed pegboard panels, (3) with a grid panel exposed to the front and a pegboard panel exposed to the back, and (4) with a pegboard panel exposed to the front and a grid panel exposed to the back). Still further, the use and arrangement of different colored panels and of different accessories such has hooks and baskets yields a virtually unlimited number of configurations that a user can employ.

To assist the user with moving the display fixture between various locations, wheel assemblies may be attached to the bottom of the base to support the display fixture above a support surface. The wheel assemblies may be provided with a wheel lock so that rotation of the wheel of the wheel assembly can either be permitted or prevented by actuating the wheel lock. Specifically, the locking members may be disengaged to permit the display fixture to be rolled across the support surface. At least some of the wheel assemblies may be caster wheel assemblies to make it easier for the user to steer the fixture as it is being moved between various locations.

As should be clear from the forgoing, the number of accessories used will depend on the configuration of the panel assemblies. At least one compartment is provided in the base to store accessories that are not in use. The compartment(s) may be closed using a removable cover.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
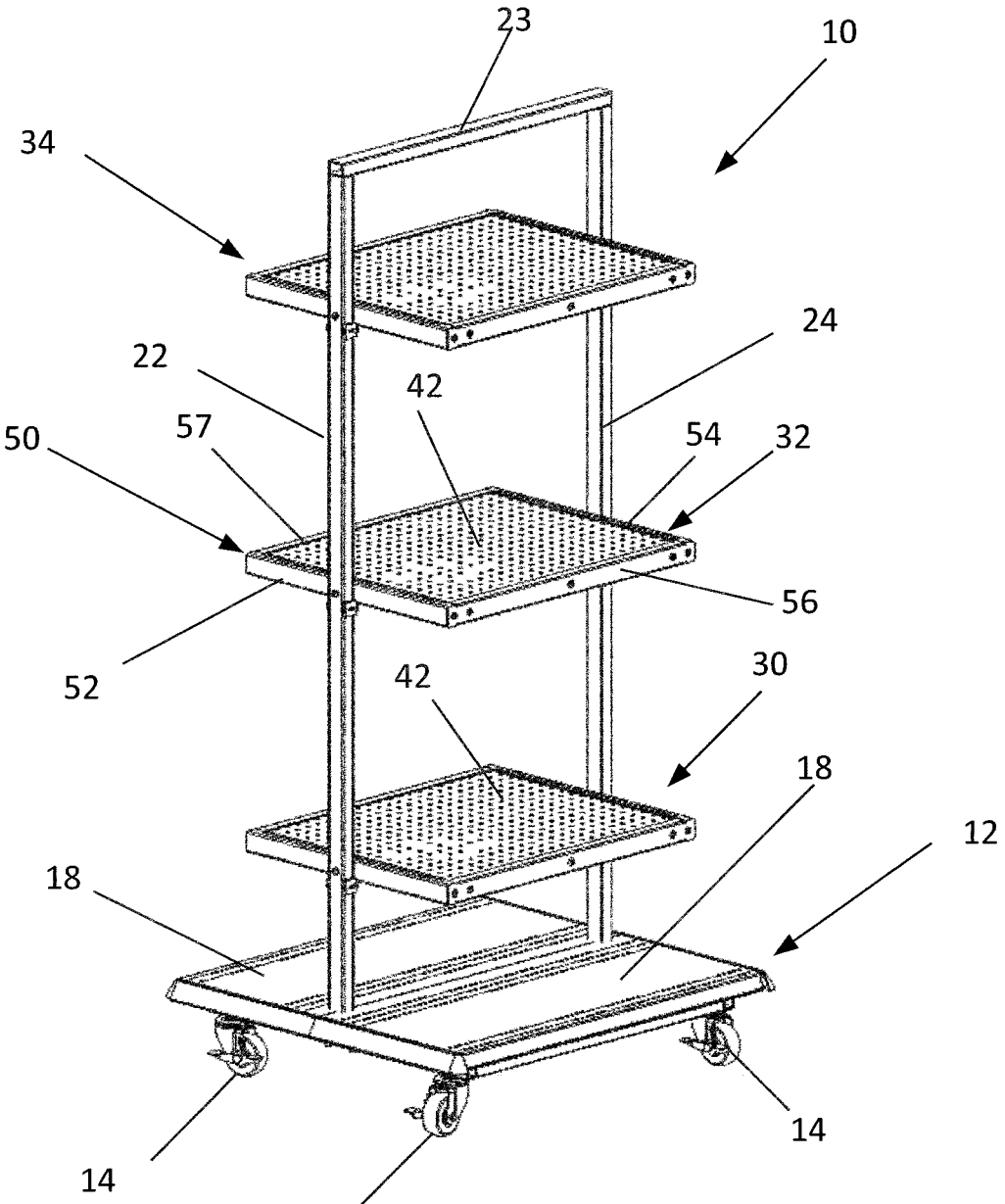
FIG. 1 is a perspective view of a display fixture made in accordance with the present invention with three display panel assemblies each in their respective horizontal positions.
Figure 2:
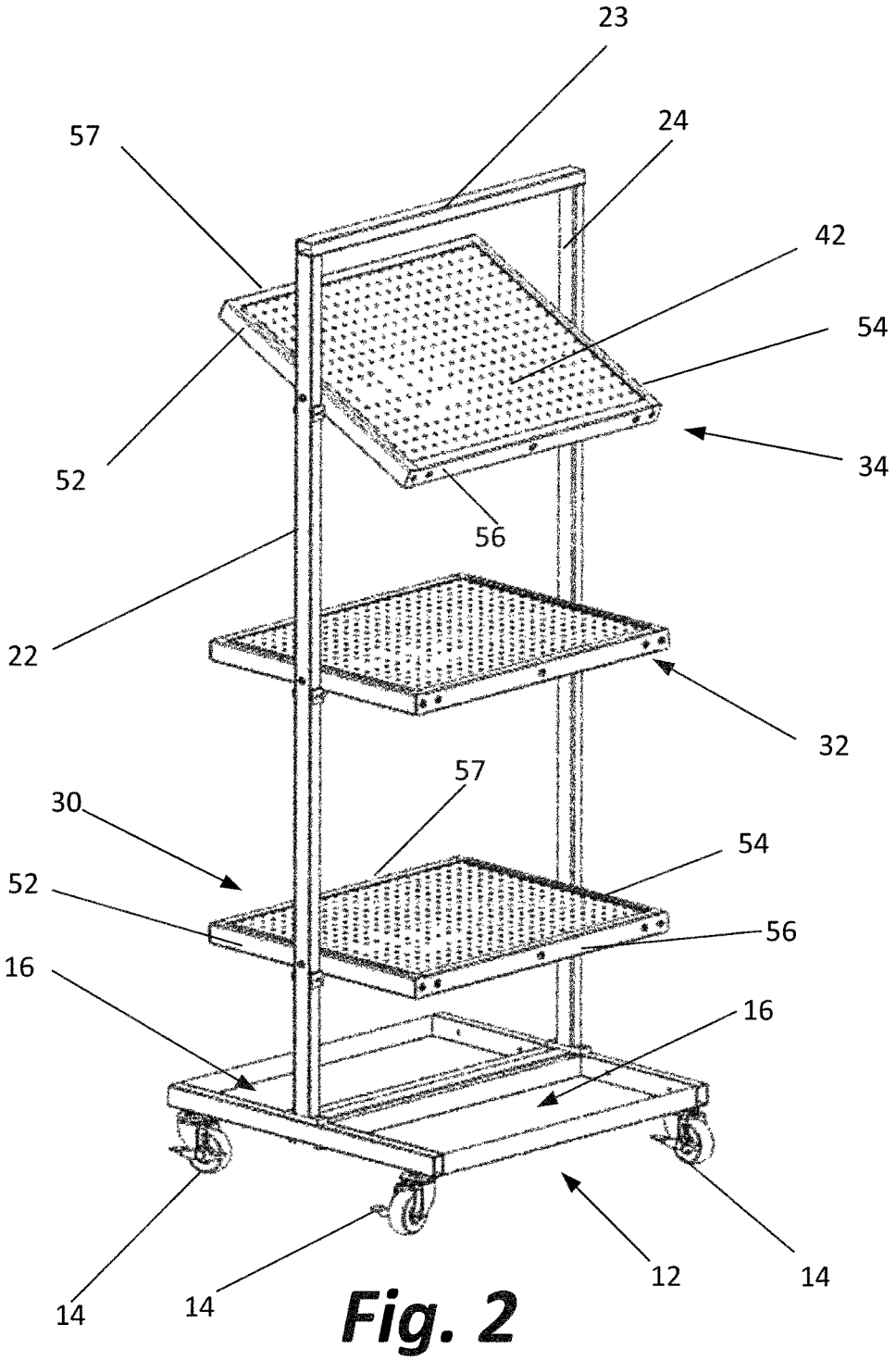
FIG. 2 is a perspective view of the display fixture of FIG. 1 with the top display panel assembly tilted slightly from its horizontal position and the other display panel assemblies in their respective horizontal positions.
Figure 3:
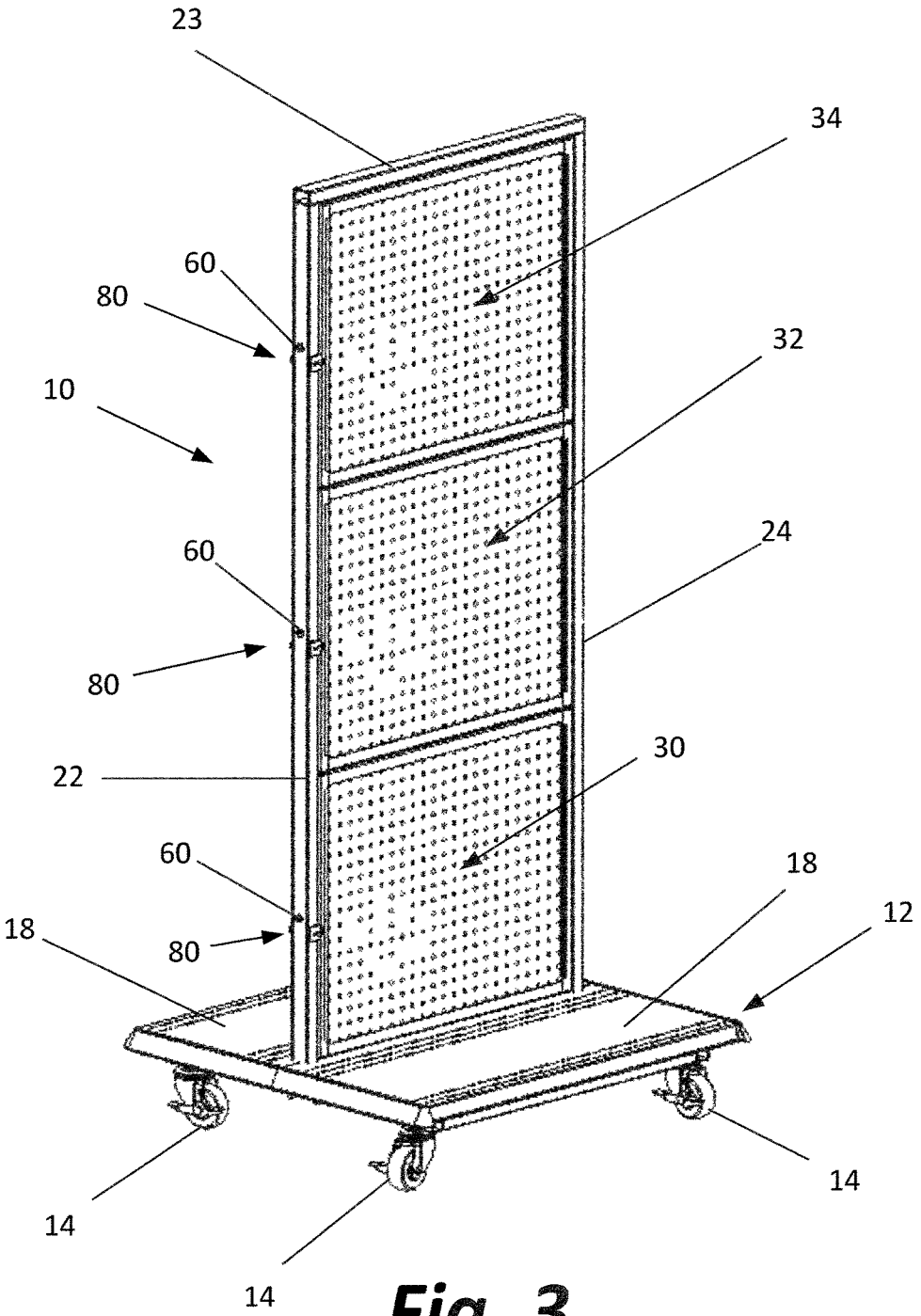
FIG. 3 is a perspective view of the display fixture of FIG. 1 with all the display panel assemblies in their respective vertical positions.

The description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressly described otherwise.

A display fixture 10 supported by a support surface 1 (such as the ground or a floor) is illustrated in the various drawings. The display fixture 10 includes a base 12. As shown in FIG. 1, the base 12 may be supported above a support surface 1 by a plurality of wheel assemblies 14 coupled to the bottom of base 12. The wheel assemblies 14 may be caster wheel assemblies as shown to assist in steering the display fixture 10 as the display fixture 10 is moved across the support surface 1. The wheel assemblies 14 may also be provided with locks as shown to selectively prevent rotation of the wheels. Such caster wheel assemblies having locks are well-known. Such locks may be engaged to fix the position of the display fixture 10 and disengaged to permit the wheels to roll and the fixture to be moved.

Figure 4:
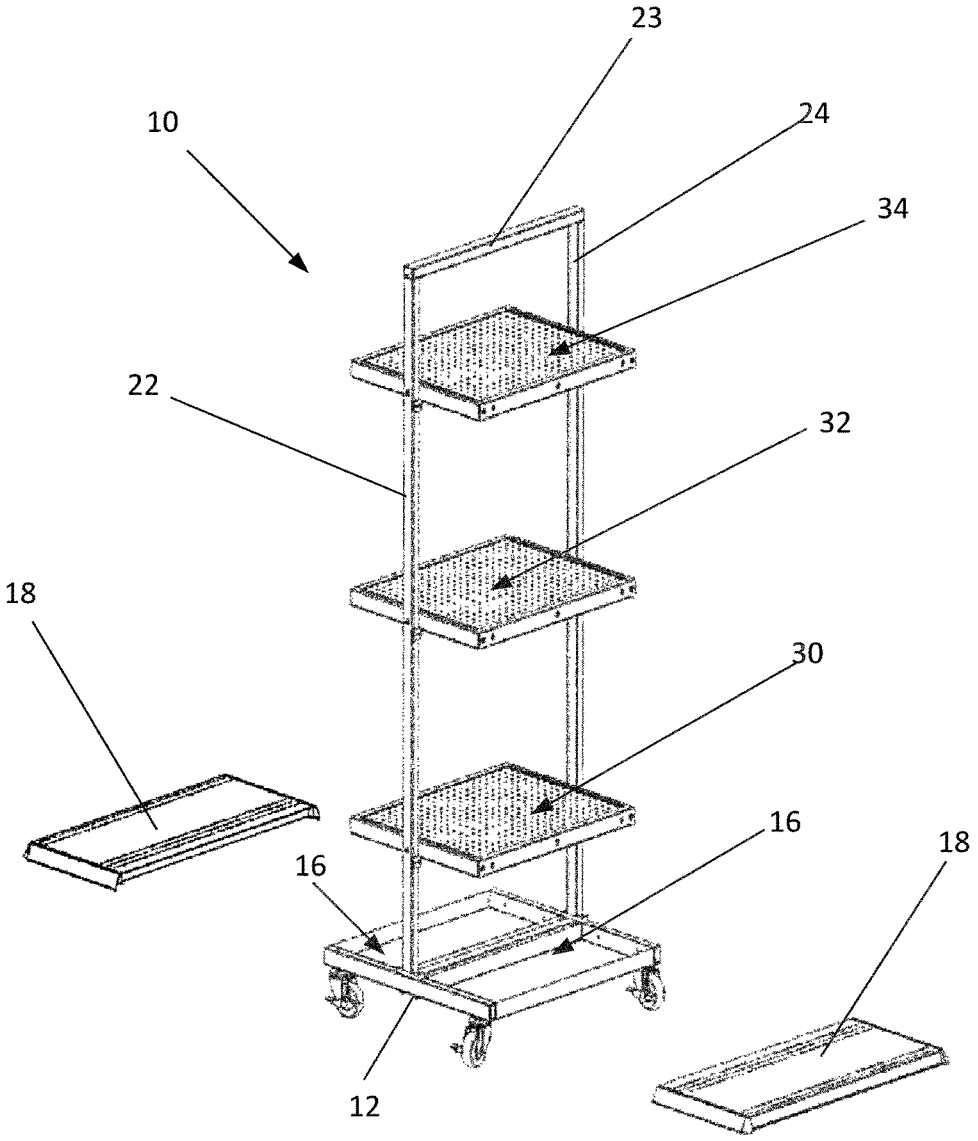
FIG. 4 is a perspective view of the display fixture of FIG. 1, but with covers for the compartments in the base removed.
Figure 5:
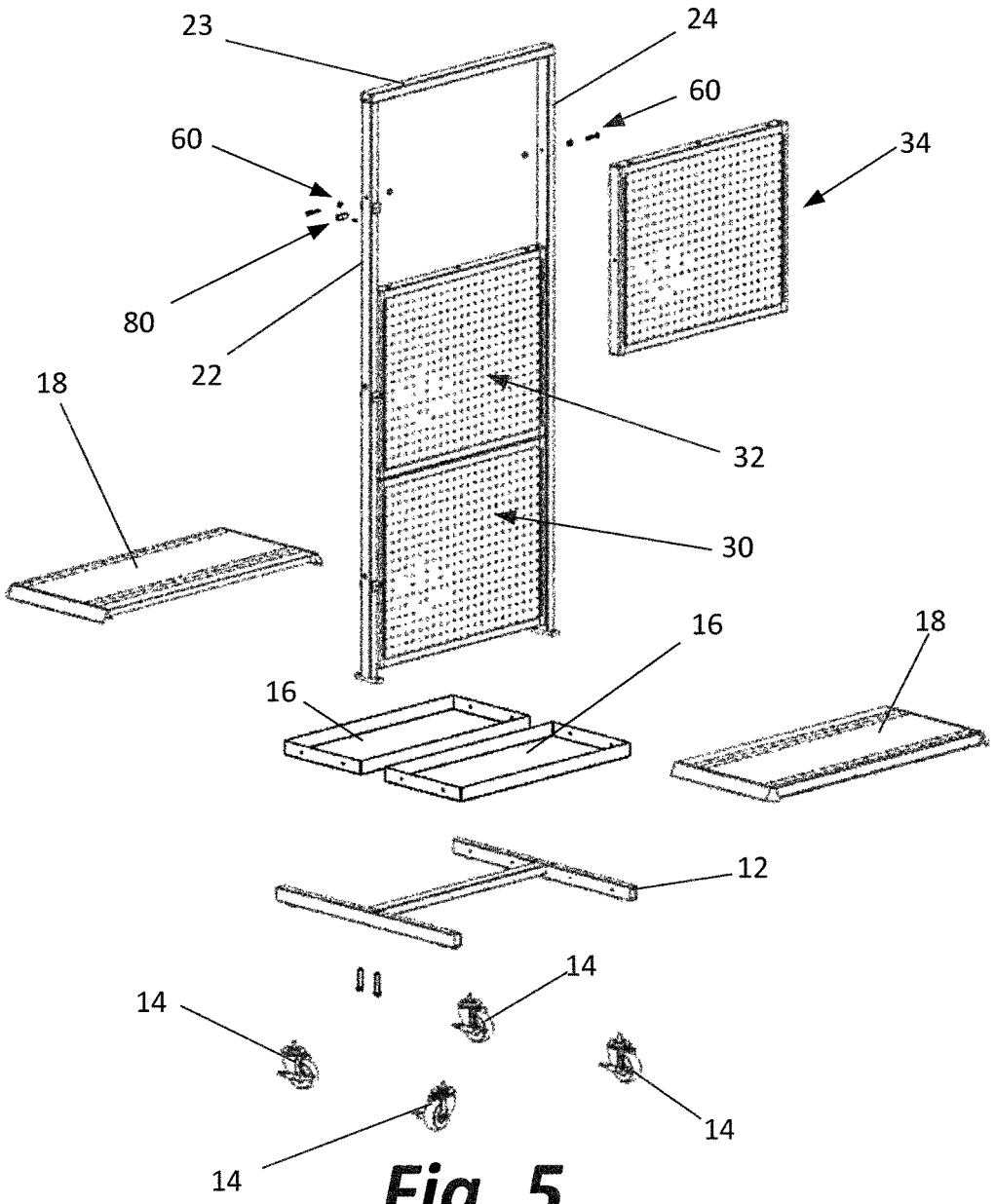
FIG. 5 is an exploded view of the display fixture of FIG. 1.

The base 12 of display fixture 10 shown in FIG. 1 supports a first vertical support rail (pillar) 22 and a second vertical support rail (pillar) 24. A top support 23 is coupled at its ends to the tops of pillars 22 and 24. As one skilled in the art will appreciate from FIG. 1, the pillars 22 and 24 may be welded directly to the base or attached to the base 12 via upstanding supports that are welded to the base and mated with open bottoms of the respective pillars 22 and 24. The pillars 22 and 24 may then be bolted to supports using standard bolts of sufficient length together with standard washers and nuts. These nuts, bolts and washers may be eliminated altogether if the supports are long enough and the tolerances between the inside of the pillars 22 and 24 and supports are sufficiently tight to prevent unintentional decoupling of the supports and pillars. Other mechanisms for attaching the pillars to the base 12 may also be employed. The base 12 may also include at least one compartment 16 having an open top and a cover 18 used to close the open top. Two such compartments 16, each having a separate cover 18, are shown in FIG. 4.

Figure 22:
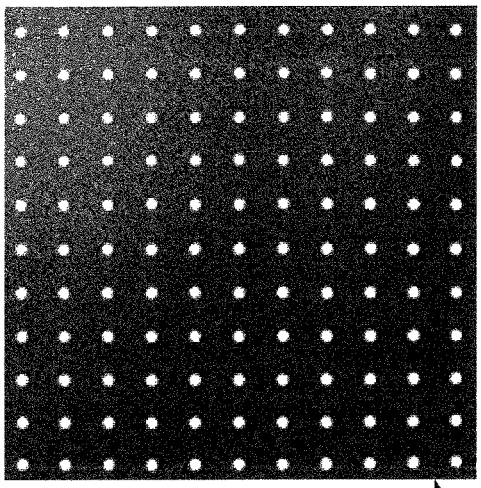
FIG. 22 is a front view of a pegboard display panel of the type that may be employed in constructing the display panel assemblies.

The pillars 22 and 24 support a plurality of display panel assemblies. In FIGS. 1-5, three such display panel assemblies 30, 32 and 34 are shown. Two or more than three display panel assemblies may be employed without deviating from the invention. Each display panel assembly 30, 32 and 34 includes at least one display panel, for example, a pegboard display panel 106 of the type shown in FIG. 22 or a grid display panel 108 of the type shown in FIG. 25. The drawings show the panel assemblies 30, 32 and 34 each including two such display panels generically referenced as 42 and 43.

The display panels 42 and 43 are held by a frame 50. Frame 50 includes a first side rail 52, a second side rail 54, and a pair of end rails 56 and 57 extended between and joining the side rails 52 and 54. At least one of the end rails 56/57 may be removable so the display panel(s) 42/43 may be slid in and out of the frame to change the type (e.g., pegboard display panel or grid display panel) or color of display panels held in the frame 50. For example, different color panels may be employed at different times of the year, e.g., greens and pastels in the spring; blues in the summer; browns, yellows and oranges in the fall; reds and greens for the Christmas holiday shopping season; red, white and blue near national holidays such as Independence Day; pink and white near Valentine's Day; etc.

A separate first pivot assembly 60 is employed to couple the side rails 52 of the frames 50 of each panel assembly 30, 32 and 34 to pillar 22. An identical separate second pivot assembly 60 is employed to couple the side rails 54 of frames 50 of each panel assembly 30, 32 and 34 to pillar 24. As such, there is a pair of pivot assemblies associated with each panel assembly, a first pivot assembly for coupling the panel assembly to pillar 22 and a second pivot assembly for coupling the panel assembly to pillar 24.

Figure 6:
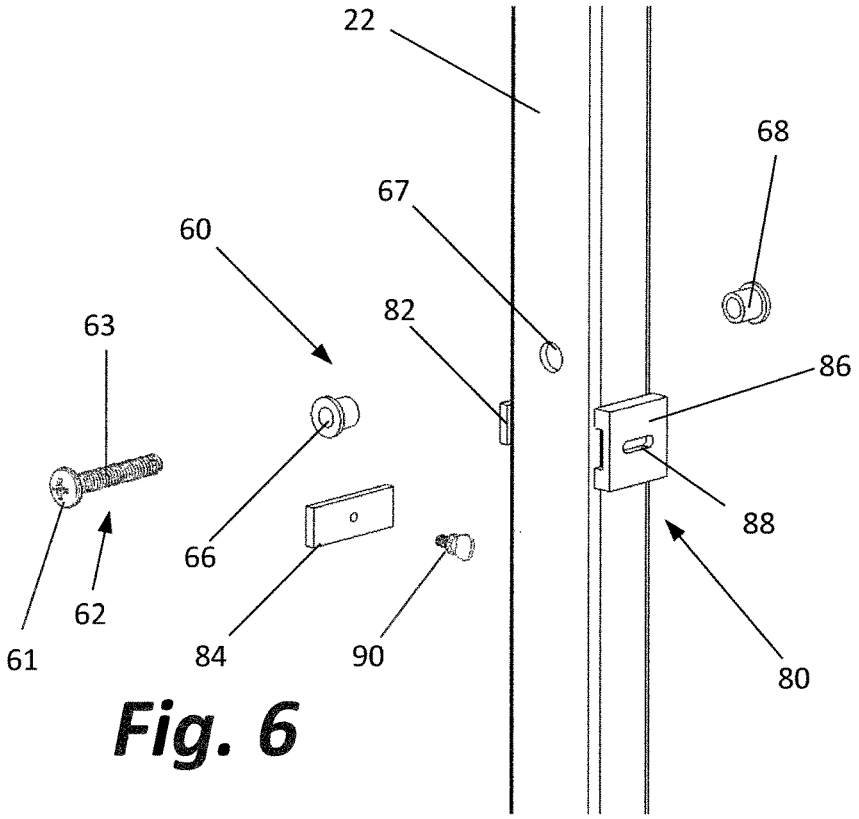
FIG. 6 is an exploded view of the pivot assembly and latch assembly of the display fixture of FIG. 1.
Figure 7:
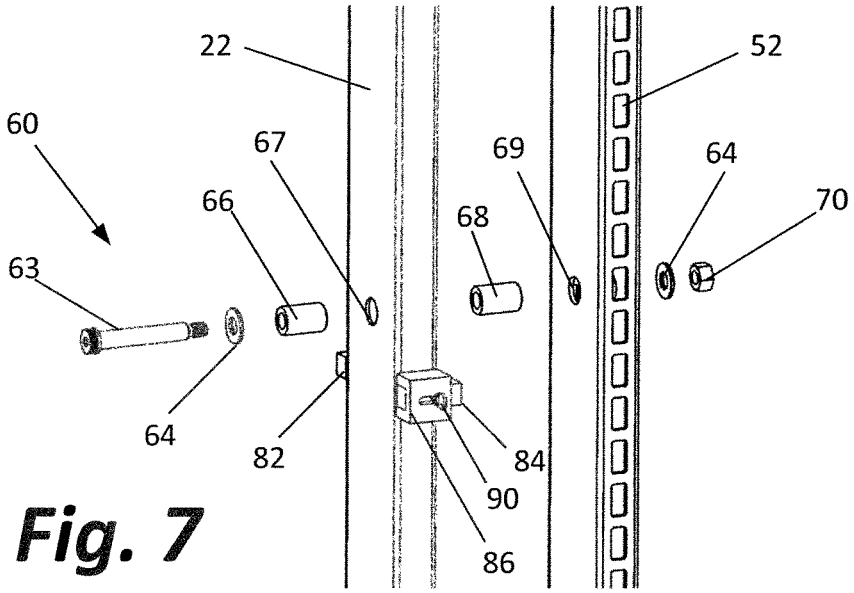
FIG. 7 is an exploded view illustrating an alternative pivot assembly.

As best shown in FIG. 7, each pivot assembly 60 includes a bolt 62 having a head 61 and a threaded shaft 63, a plurality of washers 64, a first sleeve 66 adapted to extend through a hole 67 extending through the associated pillar 22/24, a second sleeve 68 adapted to extend through a hole 69 in associated side rail 52/54 of the frame 50, and a nut 70. The threaded shaft 63 of bolt 62 is adapted to pass through the washers 64 and sleeves 66 and 68. The pivot assembly 60 is completed by then threading nut 70 onto threads of threaded shaft 63 of bolt 62 so that the rail of frame 50 is pivotally coupled to the pillar. A slightly modified pivot assembly is shown in FIG. 6.

Figure 8:
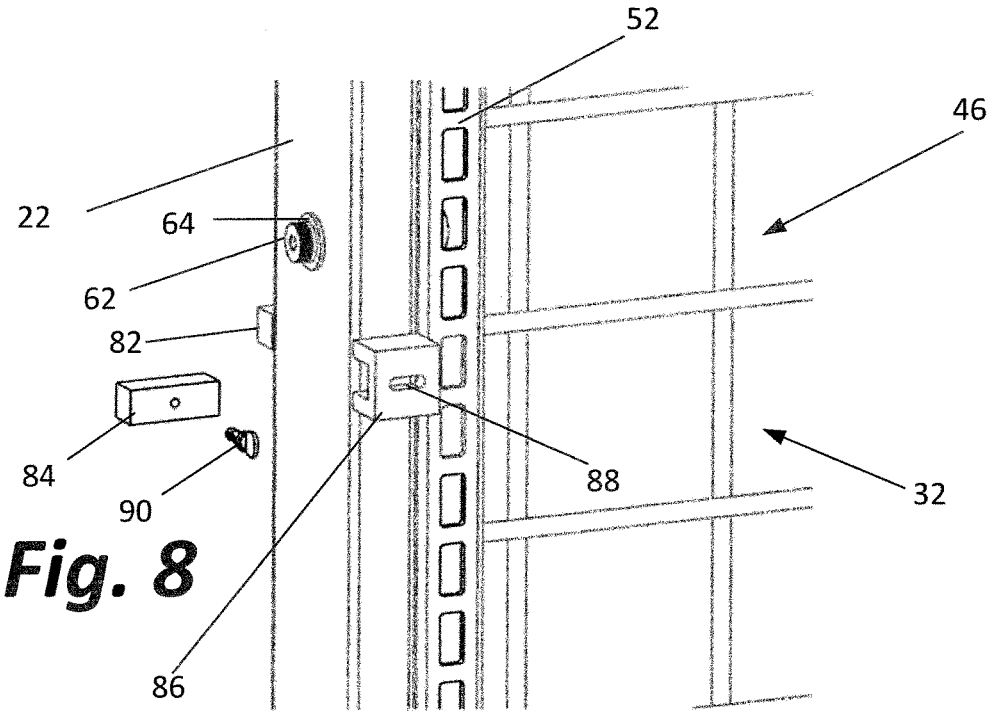
FIG. 8 is an exploded view of the latch assembly used in the display fixture of FIG. 1 and a grid panel being employed as the display panel.
Figure 9:
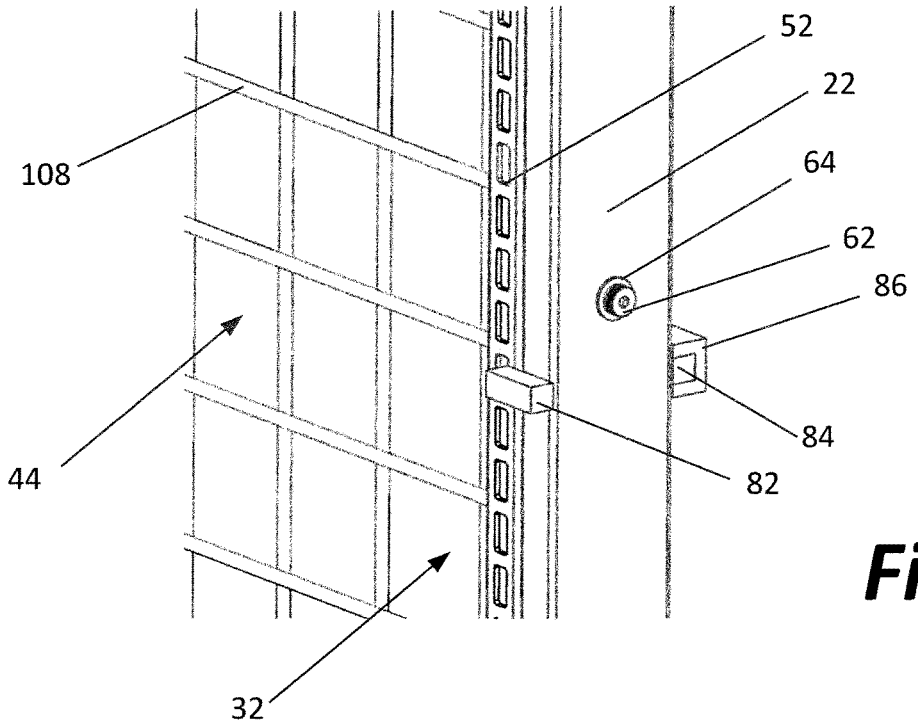
FIG. 9 is a partial perspective view further showing the various components of a latch assembly used in the display fixture of FIG. 1 and a grid panel being employed as the display panel.
Figure 10:
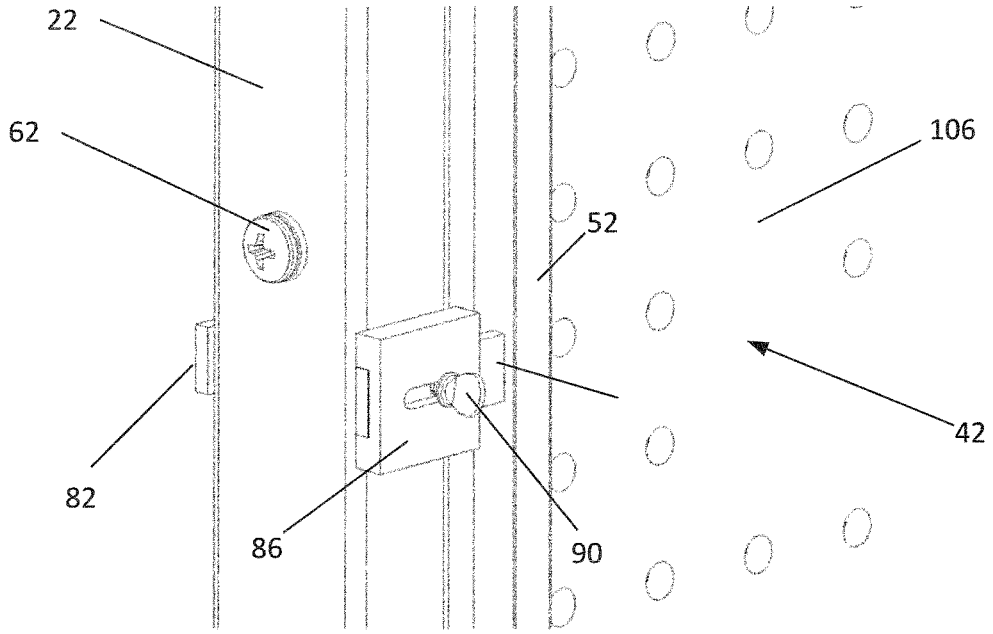
FIG. 10 is a partial perspective view showing a first embodiment of a latch assembly that may be employed when constructing the display fixture of FIG. 1 and how that latch assembly can secure one of the display panel assemblies in a vertical position.
Figure 11:
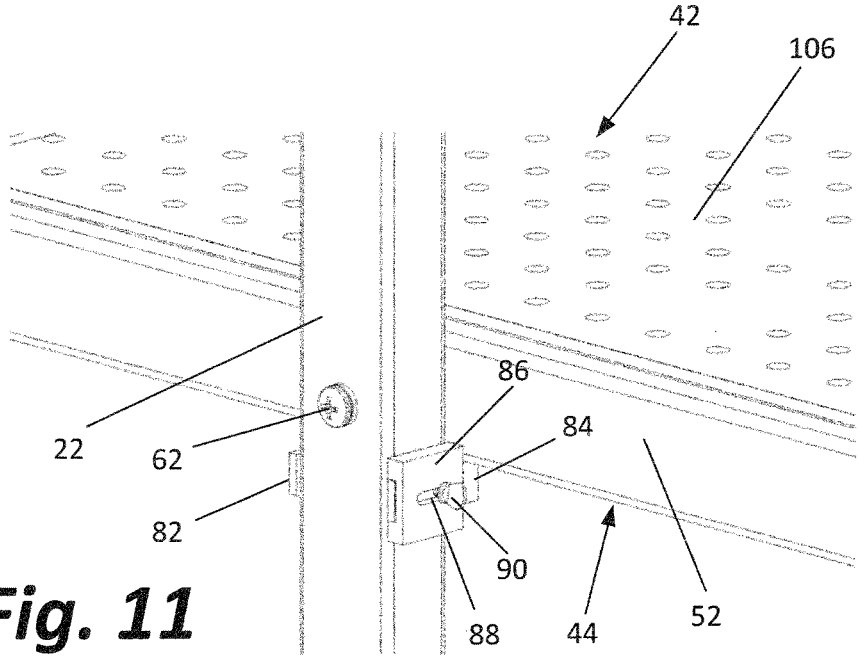
FIG. 11 is a partial perspective view of the latch assembly of FIG. 10 showing how the latch assembly can secure the panel assembly in the horizontal position.

Those skilled in the art will appreciate that the two pivot assemblies 60 use to attach a panel assembly 30, 32 or 34 to the pillars 22 and 24 are axially aligned along an axis of rotation so that the panel assembly is able to rotate between the vertical position shown, for example, in FIGS. 8-10, and the horizontal position shown, for example, in FIGS. 1, 4 and 11. Since the panel assemblies 30-34 are separately attached to the pillars 22 and 24, they may be selectively and separately pivoted between their respective horizontal positions and vertical positions as exemplified by FIG. 2. In fact, with three such panel assemblies 30, 32 and 34 as shown in FIGS. 1-5, the fixture can be configured in eight different ways as demonstrated in Table 1 below.

| | Panel Assembly 30 | Panel Assembly 32 | Panel Assembly 34 |
|---|---|---|---|
| 1 | Horizontal | Horizontal | Horizontal |
| 2 | Vertical | Horizontal | Horizontal |
| 3 | Vertical | Vertical | Horizontal |
| 4 | Vertical | Horizontal | Vertical |
| 5 | Vertical | Vertical | Vertical |
| 6 | Horizontal | Vertical | Vertical |
| 7 | Horizontal | Vertical | Horizontal |
| 8 | Horizontal | Horizontal | Vertical |

In alternative embodiments using a different number of panel assemblies, the number of possible configurations will change. If there are two panel assemblies, the number of configurations will be four (i.e., $2^2$). As additional panel assemblies are added, the number of possible configurations increases exponentially. Representative examples are illustrated in Table 2 below.

| No. of Panels | Calculation | No. of Configurations |
|---|---|---|
| 2 | $2^2$ | 4 |
| 3 | $2^3$ | 8 |
| 4 | $2^4$ | 16 |
| 5 | $2^5$ | 32 |
| 6 | $2^6$ | 64 |

Figure 12:
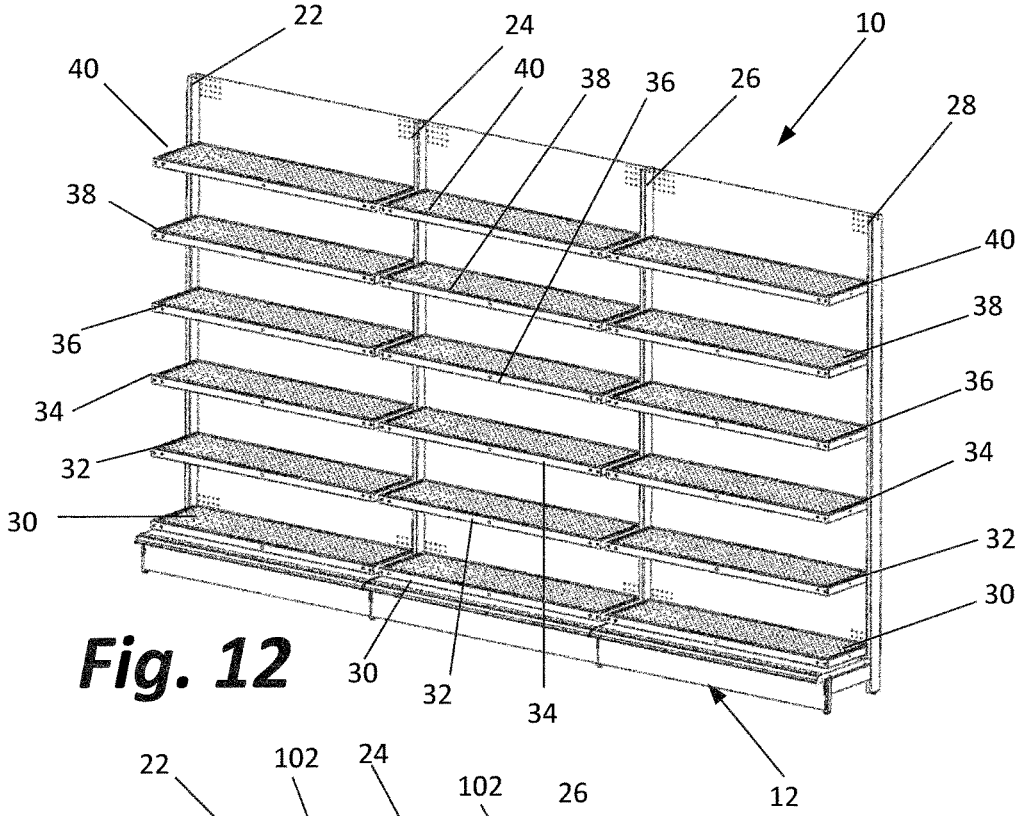
FIG. 12 is a perspective view of an alternative display fixture with each of eighteen independently positionable panel assemblies in their respective horizontal positions.
Figure 13:
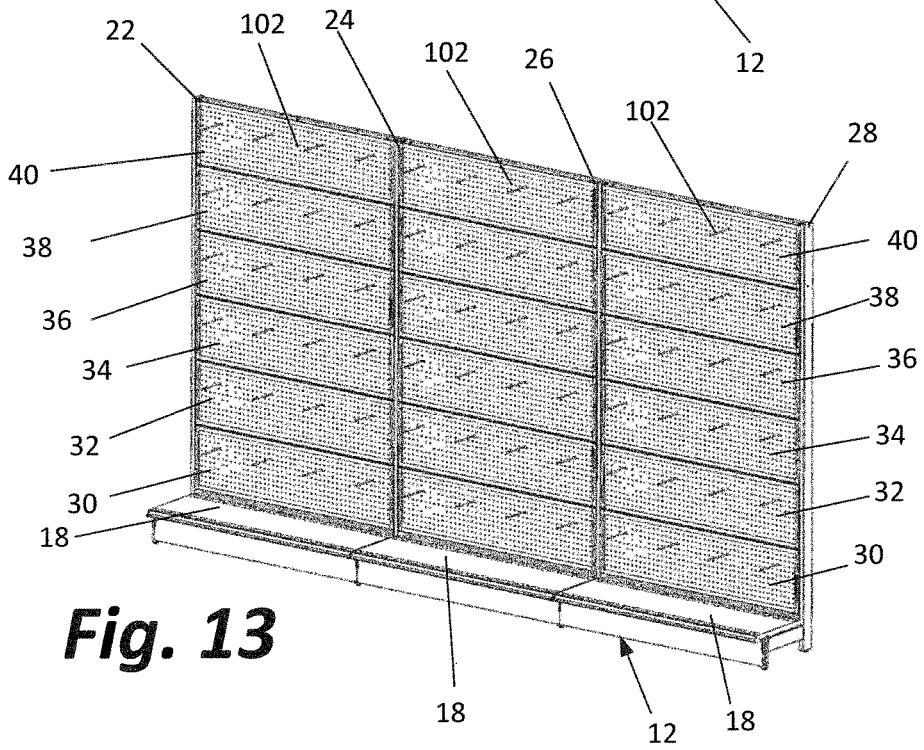
FIG. 13 is a perspective view of the display fixture of FIG. 12 with each of the independently operable display assemblies in their respective vertical positions.

FIGS. 12 and 13 show an embodiment in which there are eighteen independently operable panels arranged in three columns and six rows. In this embodiment, there are 262,144 possible configurations.

It is important to be able to selectively lock the panel assemblies in both the vertical position and the horizontal position. This may be achieved by using a separate latch assembly or a separate pair of latch assemblies for each of the panel assemblies. For example, a first latch assembly of each pair may be coupled to pillar 22 and a second latch assembly of each pair may be coupled to pillar 24 adjacent the panel assembly 30, 32 or 34 associated with the pair of latch assemblies. In some cases, only one latch assembly per display panel assembly may be necessary.

Latch assembly 80 (see, e.g., FIGS. 5-11) is well suited for use with a panel assembly pivotally mounted so that when the panel assembly is in its horizontal position a portion of the panel assembly projects forward of the pillars 22 and 24 and another portion of the panel assembly projects rearward of the pillars 22 and 24. Each latch assembly 80 comprises a stationary stop such as pin 82 which is coupled to the pillar 22/24 along one of the sides of the pillar 22/24 and below the axis of rotation defined by the pivot assemblies 60 used to couple the panel assembly to the pillars. The stationary pins permanently extend from one of the pillars 22/24 toward the other pillar. Each latch assembly 80 further comprises a retractable stop such as pin 84 coupled to the pillar 22/24 along the opposite side of the pillar 22/24 as the stationary pin 82. Pins 82 and 84 are located at substantially the same height on the pillars 22/24. As shown, the retractable pin 84 is slidably received in a pin housing 86. The pin housing 86 is also provided with a slot 88. A set screw 90 passes through the slot 88 and is turned in a first direction to lock the pin 84 to prevent pin 84 from sliding. The set screw 90 is turned in the opposite direction to unlock the pin 84 and permit it to slide between an extended and a retracted position. The set screw can also be used as a handle to slide the pin 84 in and out when the set screw is turned to the unlocked position.

As shown in FIGS. 8-10 the panel assembly 30 is held in the vertical position by a latch assembly associated with panel assembly 30. Specifically, the stationary stop (e.g., pin 82) of the latch assembly engages a first face 44 of the panel assembly 30 and the retractable stop (e.g. pin 84) engages a second face 46 of the panel assembly 30. More specifically and when two such latch assemblies are used, the side rails 52/54 of the panel assembly 30 are sandwiched between the stationary pins 82 and retractable pins 84 of the pair of latch assemblies 80 associated with panel assembly 30. To unlock the panel assembly 30 from the vertical position, the set screws 90 are loosened allowing the user to slide the retractable pins 84 outwardly so they no longer engage the second face 46 of the panel assembly 30. The panel assembly 30 can then be rotated into the horizontal position shown in FIG. 11. The panel assembly 30 can then be held in the second horizontal position by extending the retractable pins 84 and tightening the set screws 90 to lock the retractable pins 84 in their extended position and in face-to-face registration with the first face 44 of panel assembly 40. As shown in FIG. 11, both the stationary pins 82 and the retractable pins 84 engage the first face 44 of the panel assembly 30 to hold the panel assembly 30 horizontal. The arrangement of the latch assemblies 80 allows the panel assembly 30 to be repeatedly locked and unlocked and, when unlocked, rotated between the first vertical position and the second horizontal position.

Latch assemblies 80 are associated and operate in the same way with respect to panel assemblies 32 and 34 of the display fixture shown in FIGS. 1-5 and with each of the panel assemblies 30-40 of each of the three columns of panel assemblies of the display fixtures shown in FIGS. 12 and 13.

Figure 25:
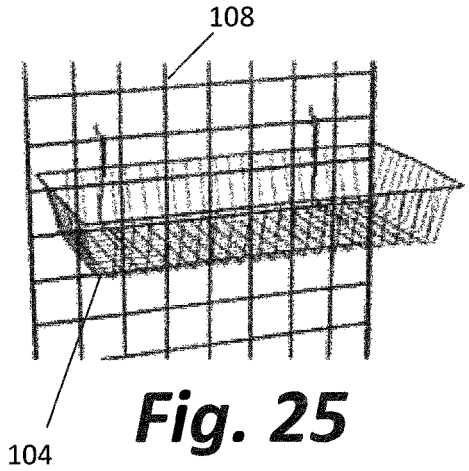
FIG. 25 is a partial perspective view of a grid display panel of the type that may be employed in constructing the display panel assemblies together with a basket removably coupled to the grid display panel.
Figure 23:
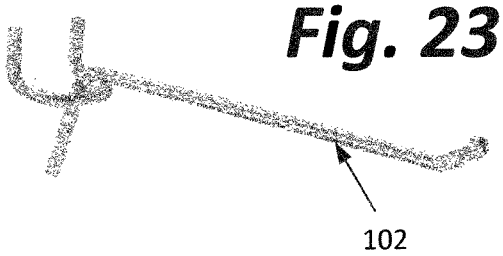
FIG. 23 is a perspective view of a hook of the type that may be employed when the display panel assemblies include a pegboard display panel.
Figure 24:
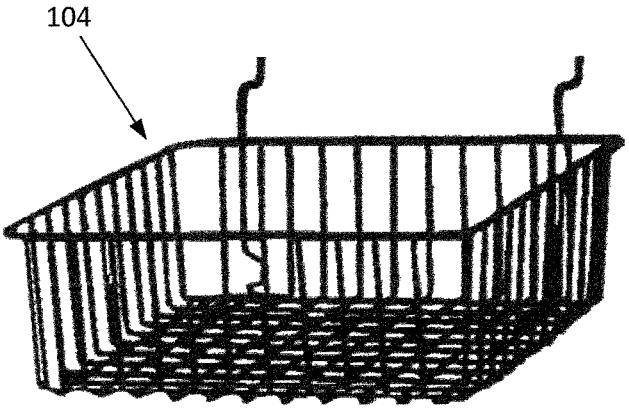
FIG. 24 is a perspective view of a basket of the type that may be employed when the display panel assemblies include a pegboard display panel.

When a selected panel assembly is in the first vertical position, the display panels allow accessories such as hooks, pegs, hangers, baskets or bins to be quickly coupled to the display panels. Examples of such accessories are shown in FIGS. 23-25. It is well known in the art how such accessories are routinely coupled to pegboards 106, grids 108 and other similar panels used in the merchandize display industry. This will not be discussed further here except to note that FIG. 13 shows hooks/hangers 102 attached to each of the eighteen display panels. In the embodiment shown in FIGS. 1-5, hooks 102 and baskets 104 (or other accessories) can be fixed to both display panels 42 and 43. These accessories thus will project in opposite directions from the first face 44 and second face 46 of the panel assembly 40 of the display fixture 10.

After removal of the hooks 102 and other accessories from one or more of the display panel assemblies, one or more of the panel assemblies (30-34 in the case of the embodiment of FIGS. 1 and 30-40 in the case of the embodiment of FIG. 12) may be rotated into the second horizontal position in which the panel assemblies so rotated serve as shelves. See, e.g., FIGS. 1 and 12. When a panel assembly is in the second horizontal position, the panel assembly provides a stable horizontal surface for the display of merchandise.

The display fixtures 10 shown in the drawings further includes one or more compartments 16 in the base 12 for storing accessories such as hooks 102. See FIGS. 2, 4, 5 and 21. Each compartment 16 has a removable cover 18 to enable access to the compartment for placing accessories in the compartment 16 or removing accessories from the compartment 16. The cover 18 is used to close the compartment 16 whenever there is no need to access the accessories and to secure the accessories in the compartment 16.

The display fixtures 10 can easily, quickly and efficiently be converted between various configurations. The display fixture 10 shown in FIGS. 1-5 can also can be easily moved about and locked in place, all by a single person and in less than a minute. Likewise, the display fixtures 10 can by converted without any tools. Display fixtures 10 can be converted without extraneous parts (other than the hooks or other accessories) that are not permanently attached. Even these accessories may be conveniently stored in the compartment(s) 16 when not in use. Thus, no parts should become separated from the display fixture 10 and lost when not in use.

The fixture 10 shown in FIGS. 1-5 is well suited for use in open areas of a retail store where customers and store staff can easily walk around the fixture 10 to place or remove items from either side of the fixture. Similar fixtures offering many of the same advantages, but designed to be positioned against a wall or other vertical surface, may also be provided in accordance with the present invention. The fixture 10 shown in FIGS. 12 and 13 is just one example.

In embodiments such as that of FIGS. 12 and 13, the pillars 22 and 24 will be moved from the center to the rear of base 12 as shown in FIGS. 12-16. Further, the pivot assemblies 60 that couple the panel assemblies 30 through 40 to the pillars 22 through 28 are moved with respect to the panel assemblies 30 through 40 so that the axis of rotation of each of the panel assemblies is immediately adjacent one end (e.g., adjacent end rail 56 or end rail 57) of the panel assembles. See FIGS. 14-16. As such, any of the panel assemblies in the horizontal position will only project forward from the pillars 22 through 28.

Figure 14:
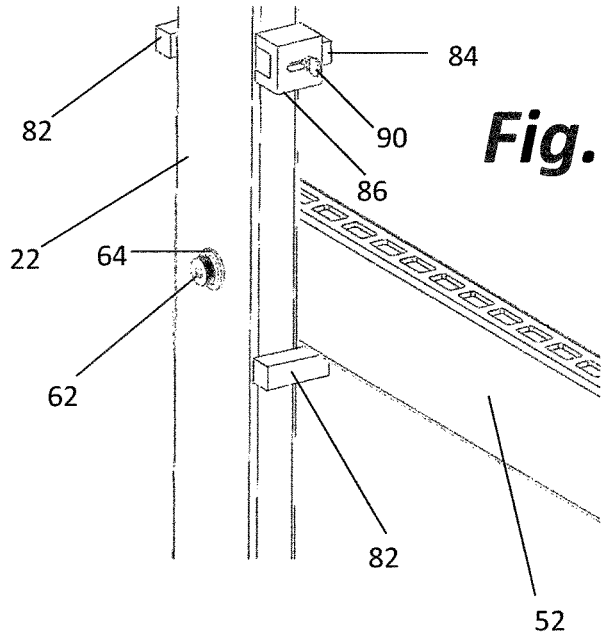
FIG. 14 is a partial perspective view showing one of the display panel assemblies of the display fixture of FIG. 12 held in the horizontal position by an alternative latch assembly.
Figure 15:
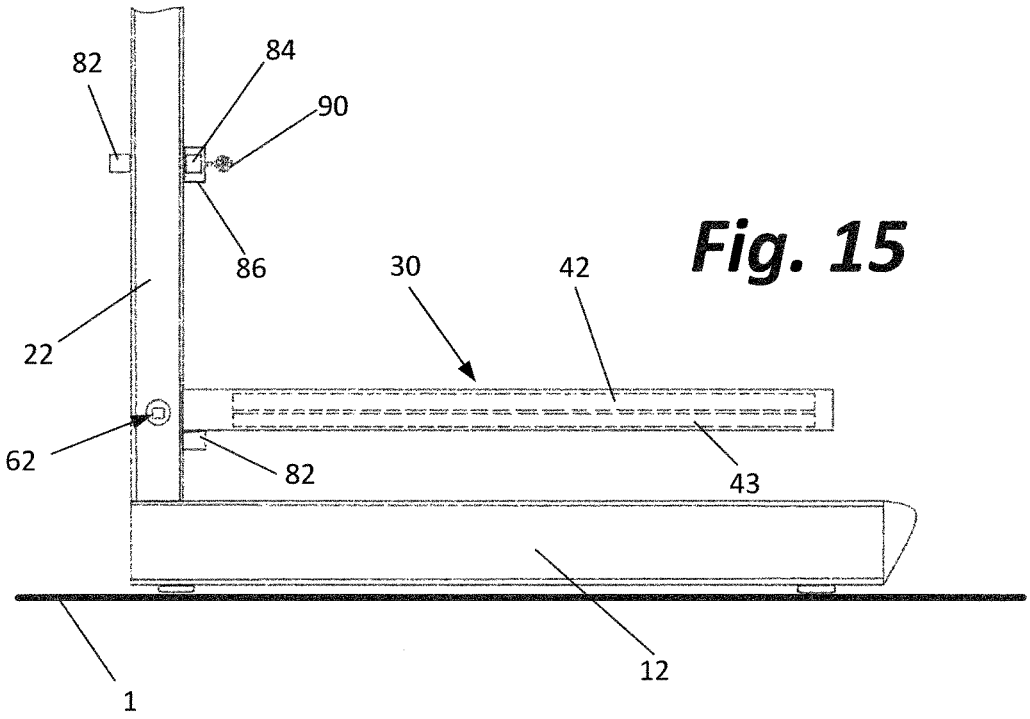
FIG. 15 is a partial side view showing one of the bottom display panel assemblies of the display fixture of FIG. 12 held in the horizontal position by the latch assembly of FIG. 14.
Figure 16:
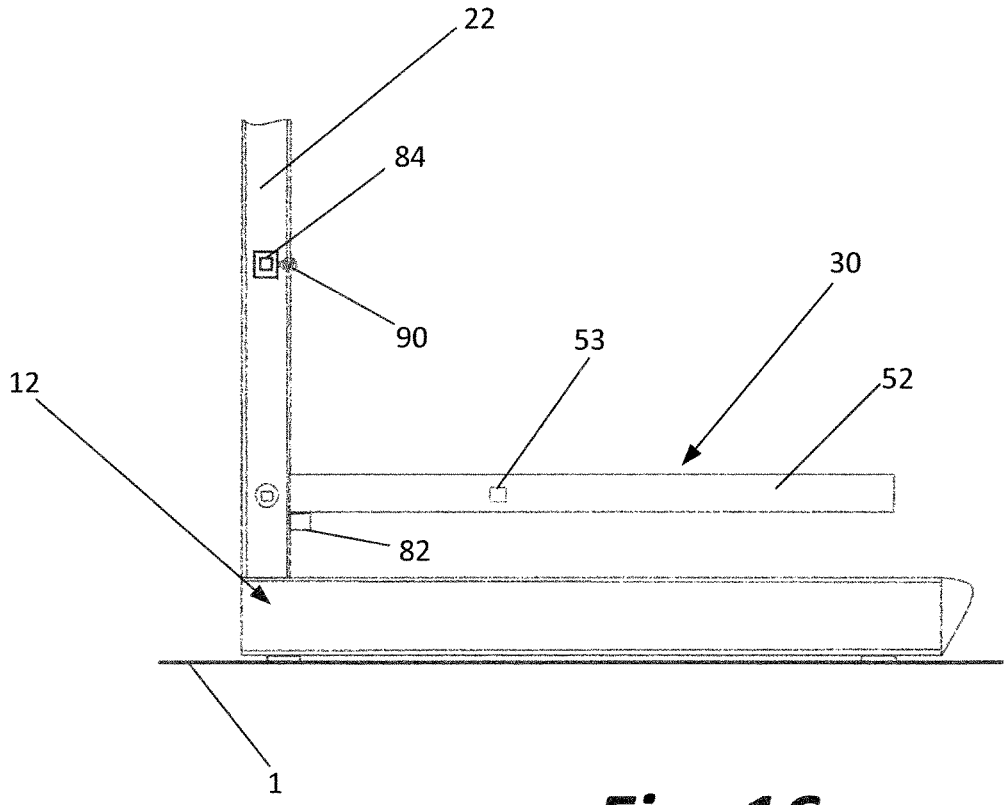
FIG. 16 is a partial side view showing an alternative embodiment of a latch assembly that may be employed when a display panel assembly is pivotally mounted to vertical support rails at the rear end of the display panel assembly as shown in FIGS. 12 and 13.

Also, the position of the pins of the latch assemblies 80 will be adjusted so that each panel assembly can be (1) supported in the horizontal position, (2) permitted to rotate between the horizontal and vertical positions, and (3) be held in place in the vertical position. In one embodiment shown in FIGS. 14 and 15, the stationary pins 82 are located on the front of the pillars (e.g., 22) so they extend beneath and support the panel assemblies in the horizontal position. The retractable pins 84 are positions higher up on the pillars so that they can engage the frames 50 of the panel assemblies to hold the panel assemblies vertical. A second stationary pin 82 may be added at the same level along the pillar as the retractable pin as shown in FIGS. 14 and 15.

Other modifications can be made without deviating from the invention. For example, the position and number of the pivot assemblies and latch assemblies and their positions on the pillars may be adjustable to accommodate different sizes of panel assemblies and different numbers of panel assemblies. Rather than using latch assemblies having retractable pins that engage a face of a panel assembly, the panel assemblies may include holes in the frame, such as hole 53 in FIG. 16, adapted to receive the retractable pin 84 to lock the panel in place. In the arrangement shown in FIG. 16, the retractable pin 84 extends through the pillar 22 and is aligned with hole 83 when the panel is vertical. The retractable pin 84 is then mated with the hole 83 to latch the display panel assembly (of which frame member 52 is a part) to secure the panel assembly in the vertical position.

Figure 17:
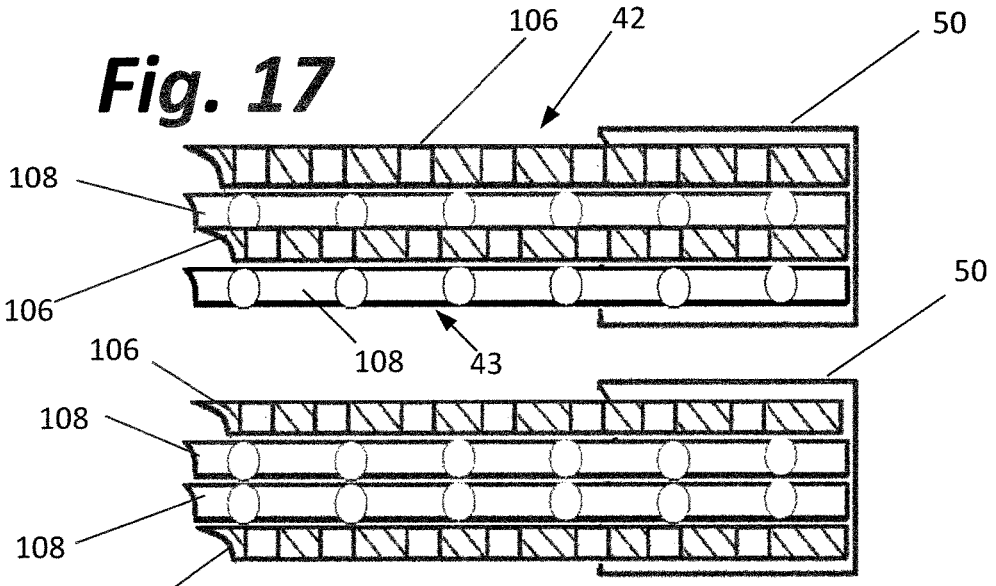
FIGS. 17-20 illustrate alternative ways that pegboard panels and grid panels can be held in the frames of the display panel assemblies of the display fixtures.
Figure 18:
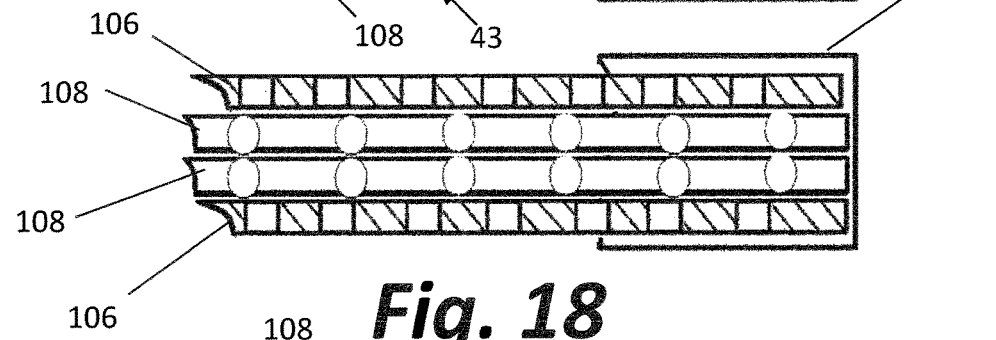
Figure 19:
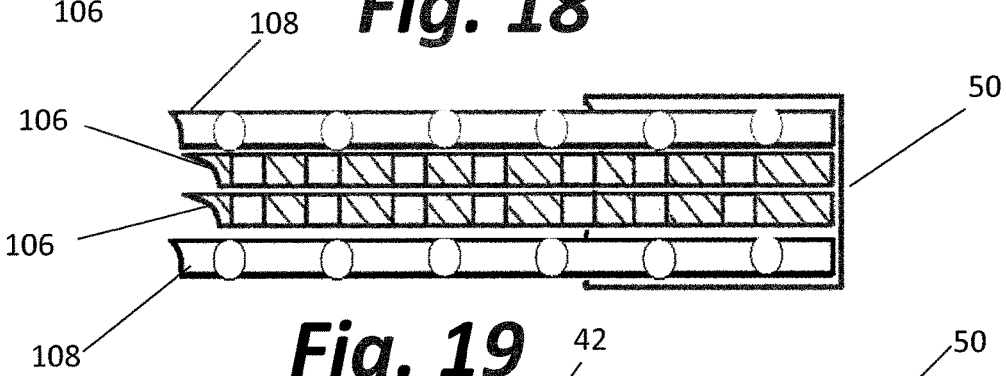
Figure 20:
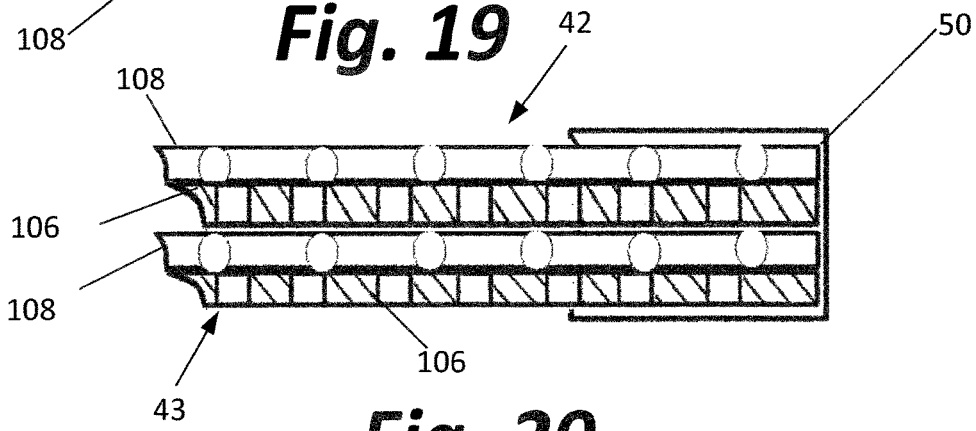

The panel assemblies may include a single display panel (such as a sheet of pegboard 106 or a grid 108) or may include two such panels. When two panels are used, one can be of a first style (e.g., a sheet of pegboard 106) and the other can be of a second style (e.g., a grid 108) or both panels can be of the same style. To provide even greater flexibility when setting up a display using the display fixture, the frames 50 of the display panel assemblies may also be designed to hold four panels, e.g., two pegboard panels 106 and two grid panels 108 which may be arranged in the frames of the panel assemblies in alternate ways as illustrated in FIGS. 17-20. As shown in FIG. 18, the two pegboard panels 106 may be positioned on the outside and exposed for use in joining accessories to the to the display panel assembly. As shown in FIG. 19, two grid panels 108 may be positioned on the outside and exposed for use in joining accessories to the display panel assembly. As shown in FIGS. 17 and 20, the pegboard panels 106 and the grid panels 108 may be arranges so that one of the exposed panels is a pegboard panel 106 and the other of the exposed panels grid panel 108. Also, because all four panels are held by the frame, the risk that any of the panels will be lost or misplaced when not in use is virtually eliminated.

Likewise, the shape of the panels and base need not be rectangular as show. They can have essentially any planar geometric shape, such as an oval shape, when viewed from the top.

Figure 21:
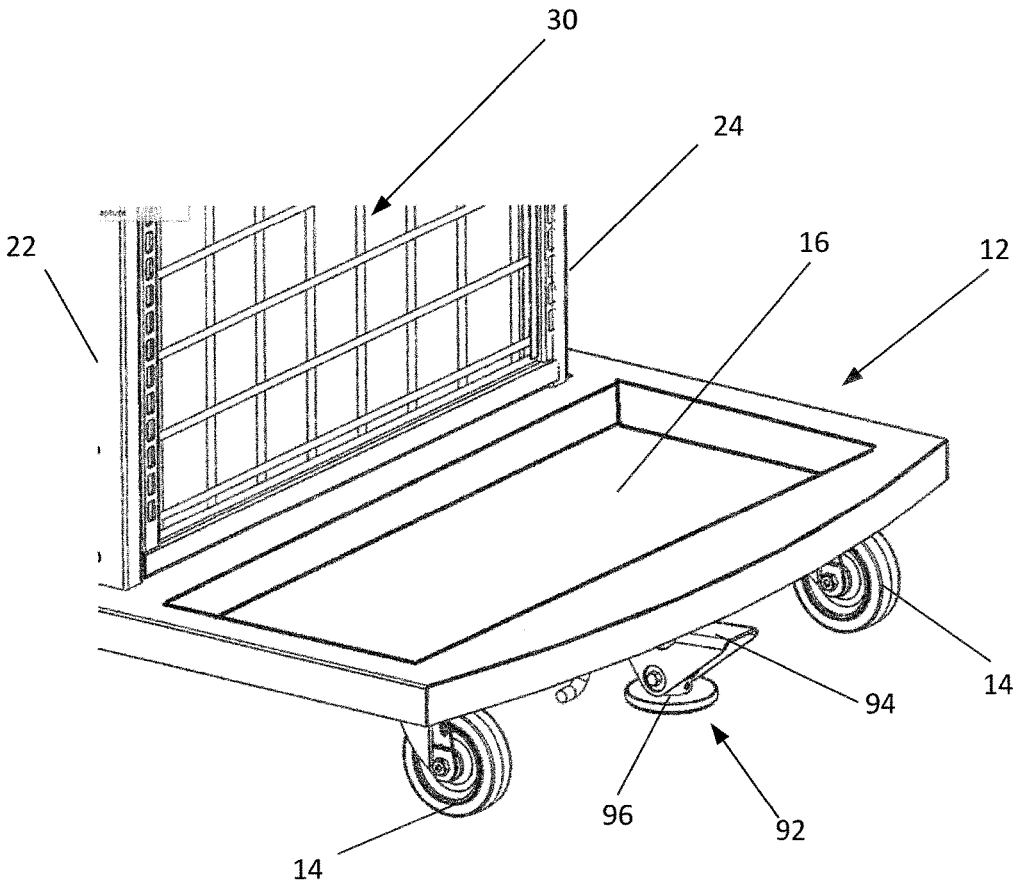
FIG. 21 is a perspective view showing a stop assembly attached to the bottom of the base of the display fixture of FIG. 1.

As shown in FIG. 21, stops 92 may be coupled to the bottom of the base 12. More than one stop may be used even though only one is shown. However, this is unnecessary if the wheel assemblies are not employed (see, e.g., FIGS. 13-16) or if the wheel base is wide enough both front to back and side to side to prevent tipping. The stop 92 shown in FIG. 21 serves to prevent the display fixture 10 from tipping relative to the support surface 1 about the axis of rotation of the wheels. The stops 92 include a lever 94 and a pad 96. The lever 94 is actuatable to lower the pad 96 into engagement with support surface 1. When the pad 96 is in this position, the pad prevents tipping of the display fixture 10 about the axis of rotation of the two wheels of the wheel assemblies 14. The lever 94 is also actuatable to raise the pad 96 slightly off and out of engagement with the support surface 1 so that the display fixture 10 may more easily be transported via the wheels between locations.

From the foregoing, it will also be appreciated that although the specific examples have been described herein for purposes of illustration, various modifications may be made without deviating from the spirit or scope of this disclosure. It is therefore intended that the foregoing detailed description be regarded as illustrative rather than limiting and that the following claims, including all equivalents, are intended to define the invention.

The invention claimed is:

1. A display fixture comprising:

a. a base;

b. first and second vertical support rails mounted to and projecting upwardly from the base in parallel, spaced apart relation; and c. a plurality of display panel assemblies, each of the display panel assemblies comprising at least one display panel held by a frame pivotally coupled to each of the first and second vertical support rails, wherein each display panel assembly is adapted to independently and selectively pivot between a horizontal position in which the display panel assembly is adapted to serve as a shelf and a vertical position in which the display panel assembly is adapted to support at least one accessory, and wherein each of the display panel assemblies is associated with at least one latch assembly adapted to be engaged to prevent the display panel assembly from pivoting and adapted to be disengaged to enable the display panel assembly to pivot between the horizontal position and the vertical position, said latch assembly comprising a stationary stop and a retractable stop.

2. The display fixture of claim 1 wherein the base is mounted on a plurality of wheel assemblies.

3. The display fixture of claim 1 wherein the base includes a storage compartment.

4. The display fixture of claim 1 wherein the base has a front end and a back end.

5. The display fixture of claim 4 wherein the first and second vertical support rails extend from an area of the base half way between the front end and the back end.

6. The display fixture of claim 4 wherein first and second vertical support rails extend from an area of the base immediately adjacent the back end.

7. The display fixture of claim 1 wherein each of the display panel assemblies comprises a second display panel.

8. The display fixture of claim 1 wherein said at least one display panel is a sheet of pegboard having a plurality of holes arranged in a pattern and said at least one accessory is a hook adapted to by coupled to at least one of the holes of the pegboard.

9. The display fixture of claim 1 wherein said retractable stop is adapted to slide between a locked position in which a selected panel assembly is prevented from pivoting and an unlocked position in which the selected panel assembly can pivot between a horizontal position and a vertical position.

10. The display fixture of claim 1 wherein the frame of at least one of the plurality of display panel assemblies is adapted to hold two pegboard panels and two grid panels.

11. A display fixture comprising:

a. a base having a front end and a back end and at least one storage compartment;

b. first and second vertical support rails mounted to the base at the midpoint between the front end and back end of the base, said first and second vertical support rails projecting upwardly from the base in parallel, spaced apart relation;

c. a plurality of display panel assemblies, each of the display panel assemblies comprising at least one display panel held by a frame, wherein said frame has a first end and a second end and is pivotally coupled along an axis of rotation between the first end and the second end to each of the first and second vertical support rails, wherein each of the display panel assemblies is adapted to independently and selectively pivot between a horizontal position in which the display panel assembly is adapted to serve as a shelf and a vertical position in which the display panel assembly is adapted to support at least one accessory, and wherein each of said display panel assemblies is associated with at least one latch assembly adapted to be engaged to prevent the display panel assembly from pivoting and adapted to be disengaged to enable the display panel assembly to pivot between the horizontal position and the vertical position, said latch assembly comprising a stationary stop and a retractable stop.

12. The display fixture of claim 11 further comprising a plurality of wheel assemblies supporting the base.

13. The display fixture of claim 11 wherein said retractable stop is adapted to slide between a locked position in which a selected display panel assembly is thereby prevented from pivoting and an unlocked position in which the selected display panel assembly can pivot between the horizontal position and the vertical position.

14. The display fixture of claim 11 wherein each of said display panels is selected from a group consisting of pegboard panels each having holes arranged in a pattern, and grid panels, and wherein said at least one accessory is adapted to be coupled to the selected panel when the panel assembly of which the selected panel is a part is in a vertical position.

15. A display fixture comprising:

a. a base having a front end and a back end, b. a plurality of vertical support rails mounted to the base adjacent the back end of the base, each of said plurality of vertical support rails projecting upwardly from the base in parallel, spaced apart relation; and c. a plurality of display panel assemblies, each of the display panel assemblies comprising at least one display panel held by a frame having a first end and a second end, wherein the frame of each of the plurality of display panel assemblies is pivotally coupled along an axis of rotation adjacent the second end to a pair of said plurality of vertical support rails, wherein each of the display panel assemblies is adapted to independently and selectively pivot between a horizontal position in which the display panel assembly serves as a shelf and a vertical position in which the display panel assembly is adapted to support at least one accessory, and wherein each of said display panel assemblies is associated with at least one latch assembly adapted to be engaged to prevent the display panel assembly from pivoting and adapted to be disengaged to enable the display panel assembly to pivot between the vertical position, said latch assembly comprising a stationary stop and a retractable stop.

16. The display fixture of claim 15 wherein the base includes a storage compartment.

17. The display fixture of claim 15 wherein said retractable stop is adapted to slide between a locked position in which the selected display panel assembly is thereby prevented from pivoting and an unlocked position in which the selected panel assembly enabling the selected display panel assembly can pivot between the horizontal position and the vertical position.

18. The display fixture of claim 15 wherein when a selected display panel assembly of the plurality of display panel assemblies is in the vertical position, the second end of the selected display panel assembly faces downwardly.

19. The display fixture of claim 15 wherein each of said display panels is selected from a group consisting of pegboard panels each having holes arranged in a pattern, and grid panels, and wherein said at least one accessory is adapted to be coupled to the selected panel when the display panel assembly of which the selected panel is a part is in the vertical position.

20. The display fixture of claim 15 wherein said display panel assemblies are arranged in a plurality of rows and a plurality of columns.

* * * * *